United States Patent [19]

Stern

[11] 4,300,685

[45] Nov. 17, 1981

[54] MULTIPLE PARTICLE PACKAGE AND METHOD

[75] Inventor: Walter Stern, Wilmette, Ill.

[73] Assignee: Johns-Manville Corporation, Denver, Colo.

[21] Appl. No.: 124,177

[22] Filed: Feb. 25, 1980

[51] Int. Cl.[3] ..... B65D 63/00; B65D 63/10; B65D 85/62

[52] U.S. Cl. ..... 206/499; 206/597; 206/526; 206/503

[58] Field of Search ..... 206/526, 597, 499, 503; 229/52 BC, 28 BC

[56] References Cited

U.S. PATENT DOCUMENTS

| | | | |
|---|---|---|---|
| 2,895,608 | 7/1959 | Wilson | 206/597 |
| 2,896,207 | 7/1959 | Wilson | 206/597 |
| 2,915,208 | 12/1959 | Benschoter | 206/499 |
| 3,289,828 | 12/1966 | Dick et al. | 206/597 |
| 3,362,613 | 1/1968 | Desmond et al. | 229/28 BC |
| 4,217,983 | 8/1980 | Stout | 229/28 BC |

*Primary Examiner*—William T. Dixson, Jr.
*Attorney, Agent, or Firm*—Robert M. Krone; Joseph J. Kelly; Norvell E. Von Behren

[57] ABSTRACT

A multiple article package is disclosed wherein a plurality of articles such as folded basket beverage containers having a lenticular shape are tightly banded together in a lenticular shaped bundle by at least one diagonally positioned band. The tightly banded lenticular shaped bundle of articles then are packaged in an outer restraint with the articles being utilized to carry the weight of similarly packaged articles that may be loaded on top of the outer restraints. The method utilizes the banded carriers along with the outer lightweight non-load bearing restraint to provide a novel packaging method for shipping the plurality of folded basket beverage carriers to the customer. The invention may be utilized with many types of lenticular shaped articles including the beverage containers shown in the drawings.

9 Claims, 14 Drawing Figures

MULTIPLE PARTICLE PACKAGE AND METHOD

BACKGROUND OF THE INVENTION

This invention relates to a package and method for shipping a plurality of multiple articles and more particularly is directed to a new and novel method for packaging and shipping a plurality of folded basket beverage carriers having a lenticular cross-section when folded flat and when banded together.

The present system of shipping folded basket beverage carriers to the customer is by utilizing what is known in the art as a standard RSC container (regular slotted container). Such a container is shown in the Applicant's drawing FIG. 3 and is labeled generally with the numeral 10. The container 10 has placed therein a plurality of folded basket beverage carriers 12 of the type shown in FIGS. 1 and 2 of the drawing. The beverage carrier 12 generally has a central section 14, an upper offset handle section 16 which is fixed to the central section 14. In addition, the carrier 12 has a lower offset bottom section 18 also fixed to the central section 14. By referring to FIG. 2, there is shown an end view, taken along line 2—2 of FIG. 1 showing the nature of the folded beverage carrier 12 and what is meant by a lenticular shape. The carriers may also be formed in shapes other than lenticular. Beverage carriers of the type described may consist of up to eight material layers in the central section 14 which would result in a thickness shown generally by the arrows 20 in FIG. 2. In addition, the upper handle section 16 may consist of only two material layers resulting in a thickness of lesser amount and as shown by the arrow 22 in FIG. 2. The upper handle section 16 may also consist of more than two material layers depending upon the particular carrier design. In addition, the lower offset bottom section 18 may consist of only two thicknesses of material as shown by the arrow 24 in FIG. 2 and may also consist of more thicknesses. Because of the varying thicknesses described and also due to the fact that the carrier has provided on the outside thereof a protective coating, an inherent slip is imparted between two similar carriers whenever the carriers are stacked side by side or on top of each other. The lenticular shape is illustrated by the dashed line numbered 26 in FIG. 2 and would represent that shape taken by the carrier whenever a plurality of similarly constructed carriers were folded flat and were banded together and stacked.

Conventional strapping or banding of these carriers cannot be used because such banding imparts a deleterious warp to the articles and, from their unique shape of the central section 14 in combination with the upper handle 16 and the lower offset bottom section 18, the stack of carriers is not able to remain "squared up" during shipment. It has been found that under vibration and impact conditions, the stacks of folded carriers would start to swivel, fan out, turn and disintegrate.

It is known in the prior art to horizontally band loose articles and vertically stack them on top of each other as shown by the U.S. Pat. No. 2,874,834, issued to W. W. Woodward on Feb. 24, 1959. This patent concerns rectangular articles which are stacked but the articles do not present the problems presented by the packaging of the before mentioned folded basket beverage carriers having multiple thicknesses of material when folded. It is also known to band container blanks having a rectangular shape as taught in the U.S. Pat. No. 2,896,207, issued to H. W. Wilson on July 21, 1959 and the U.S. Pat. No. 2,979,871, issued to H. W. Kieckhefer on Apr. 18, 1961. The Wilson patent is directed to rectangular articles such as knocked down flat corrugated boxes which are banded under compression are palletized on edge in such a manner that a full pallet structure becomes unnecessary. The Kieckhefer patent concerns a banding method for flat, rectangular stacks of cartons in which the strap is replaced by a tension glued broad container board band applied in compression. These patents have little in common with the Applicant's novel invention other than utilizing banding which is a technique widely used in palletizing today.

It is also known to package a plurality of multiple articles by scoring them and wrapping the scored and folded articles for shipment with the wrapped package being banded in several places on the outside thereof. This is shown in the U.S. Pat. No. 2,340,422, issued to T. S. Okonski on Feb. 1, 1944. This patent utilized known strapping techniques over protective corrugated outer sheets to unitize objects for palletized shipment and is not directed to the same problem presented by folded basket beverage carriers having lenticular shapes when packaged.

SUMMARY OF THE INVENTION

In order to overcome the problems inherent in the prior art packages and methods herein before described when related to a folded basket beverage carrier having a lenticular shape, when folded flat there has been provided by the subject invention a new and novel package and method wherein the basket carriers are aligned so that the upper offset handle sections 16 are aligned together. The aligned carriers are then tightly banded around the central section in at least one position to form a diagonally positioned band between the upper offset handle section 16 and the lower offset bottom section 18 to form a plurality of folded lenticular shaped carriers in a lenticular shape bundle. This lenticular shaped bundle is capable then of carrying a predetermined amount of weight that may be applied to it whenever the carriers are positioned in the non-load bearing outer package shown and described herein. The package comprises a lightweight, non-load bearing outer restraint positioned around the plurality of bundles with the restraint being constructed so that the bundles are stacked in the restraint in such a manner that the plurality of bundles carry a major portion of the weight of a similar package that may be positioned on top thereof with the restraint carrying a relatively minor portion of the load. By the use of the non-load bearing outer-restraint, the costly regular slotted container used in prior art packages can be eliminated.

The restraint may take several forms and there is shown in the Applicant's drawings three forms of the restraint with one form being a two-piece telescoping container having an upper outer container and a lower inner container while another form of the restraint would be a three-piece container comprising a top cap and a bottom cap positioned around an intermediate sleeve. A third form of the restraint would comprise an outer shell structure into which a plurality of the lenticular bundles of beverage carriers were positioned with a plurality of the shell structures and bundles of carriers being positioned together and placed on a pallet. The shell structure would be restrained on the pallet by a plurality of straps positioned around the bundles of carriers and through the pallet. Because of the lenticular nature of the folded beverage carriers, in the various forms of the restraint, it has been found from experimentation, that it is desirable that the lenticular shaped bundles are alternately positioned inside the restraint in such a manner as to provide more stability in the restraint when the bundles are stacked one on top of the other.

When such a package is constructed, the banded lenticular shaped bundles of beverage carriers then are utilized as described in the preferred embodiment hereinafter described to carry the weight of a similarly loaded package which has been placed on top of the lower package. When formed thusly, it can be seen that the outer restraint can be designed of a lighter weight material since it is not required to carry a major portion of the load and would only carry a relatively minor portion of the load as will be discussed hereinafter. Such a construction results in cost savings to the ultimate consumer of the beverage carrier.

Accordingly, it is an object and advantage of the invention to provide a new and novel lightweight package of multiple quantities of basket beverage carriers which may be tightly banded together forming a bundle of lenticular shape and may be packaged in an outer non-load bearing restraint.

Another object and advantage of the invention is to provide an improved packaged quantity of folded basket beverage carriers which are tightly banded together into a lenticular shape bundle which is capable of carrying predetermined amounts of weights that may be applied thereto.

Still yet another object and advantage of the invention is to provide a new and improved package for a multiple quantity of folded basket beverage carriers which requires a lightweight, non-load bearing outer restraint poisitioned around the folded carriers.

Yet another object and advantage of the invention is to provide a new and novel method for packaging a plurality of folded basket beverage carriers wherein the carriers are utilized to carry the weight of a package of similarly packed carriers that may be stacked on top of the lower package.

A further object and advantage of the invention is to provide a package of beverage carriers that may be quickly removed from the outer restraint and rapidly loaded in the hopper of a machine simply by placing the package of carriers in the hopper and cutting the banding strap to release the carrier.

These and other objects and advantages of the invention will become apparent after a review of the various figures of the Applicant's drawing and from a reading of the preferred embodiment hereinafter given.

DESCRIPTION OF THE PREFERRED EMBODIMENT

Figure 5:
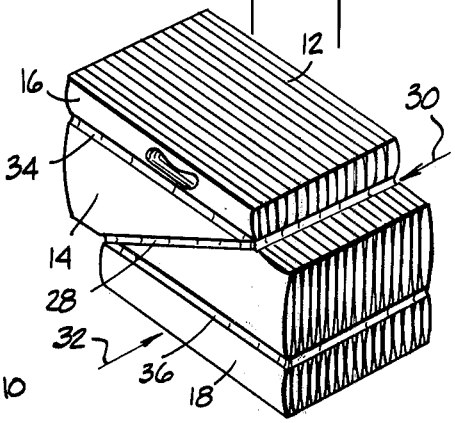
FIG. 5 is a perspective view of the banded lenticular shaped carriers shown in FIG. 4 showing the lenticular shape which the carriers bundled assume upon being banded while under compression.

Referring now to the drawings in general and in particular to FIG. 5 of the drawing there is shown a plurality of prior art basket carriers 12 having their upper handle section 16 aligned together and having a plastic band 28 being positioned tightly around the central section 14 of the carrier. Prior to being banded as shown in FIG. 5, the plurality of carriers 12 are compressed by outer forces shown generally by the arrows 30 and 32. The outer forces 30 and 32 would be applied by a specialized machine forming no part of the Applicant's present invention and the machine would hold the plurality of article carriers 12 tightly compressed while the plastic band 28 has been applied to the bundle by known banding techniques.

Figure 4:
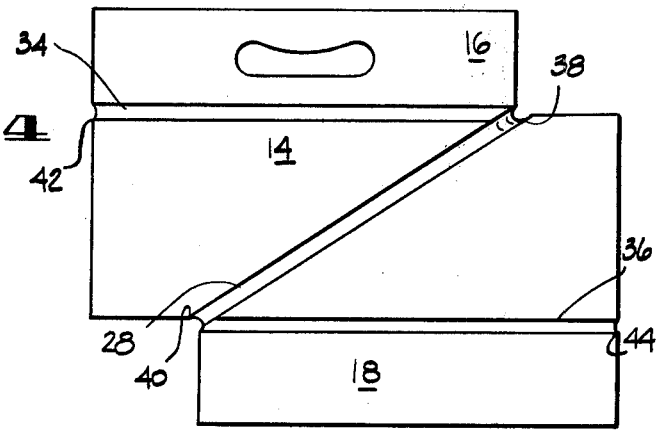
FIG. 4 is a side view of the beverage carrier showing it diagonally banded as taught by the Applicant's invention and also showing an upper and lower band applied around the carrier.

It can be seen by referring to FIG. 5 how the plurality of lenticular shaped multiple article carriers 12, when banded, form a tight lenticular shaped bundle which may be easily placed in a machine hopper as before mentioned. It may also be desirable to apply at least one horizontal plastic band 34 around the upper handle section 16 and it may also be desirable to provide at least one horizontal plastic band 36 around the lower offset bottom section 18. If desired by the customer, only one horizontal band 34 or 36 may also be applied to the bundle and it is within the spirit and scope of the invention that both horizontal bands 34 and 36 may be applied to the bundle along with the diagonal band 28. In the preferred embodiment, the band 28 as well as the bands 34 and 36 would be formed from plastic strap but could also be formed from metal, paperboard and other compositions within the spirit and scope of the invention. It may also be desirable to have the multiple article carriers 12 formed with strategically placed notches 38 at the inner section of the upper carrier handle section 16 and the central carrier section 14 as shown in FIG. 4 of the drawing. It may also be desirable to have the multiple article carrier 12 constructed with a similar notch 40 being positioned at the inner section of the lower offset bottom section 18 and the central carrier section 14. The purpose of the notches 38 and 40 would be to relieve the stresses caused by the tightly applied plastic diagonal band 28. The notches 38 and 40 would then tend to keep the bundle of article carriers 12 from being deformed after being tightly wrapped which would minimize problems in opening the carriers whenever they would later be positioned in a carrier opener machine.

It may also be desirable to provide a similar notch 42 positioned as shown in FIG. 4 of the drawing at the inner section of the central section 14 and the upper handle section 16 and also a notch 44 positioned at the inner section of the central section 14 and the lower offset bottom section 18. The size and depth of the notches would be predetermined according to the width of the various bands 28, 34 and 36 and in keeping with the overall appearance of the article carrier 14.

Figure 1:
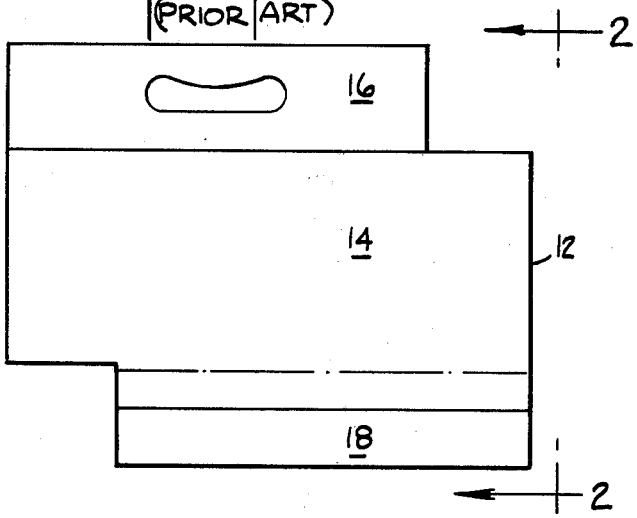
FIG. 1. (PRIOR ART)
FIG. 1 is a side view of a prior art folded basket beverage carrier of the type herein described which is packaged in the Applicant's new and novel package.
Figure 2:
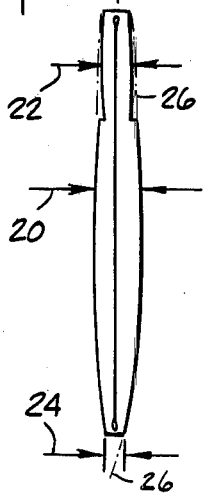
FIG. 2 (PRIOR ART)
FIG. 2 is a side view, taken along line 2—2 of FIG. 1, showing the multiple thicknesses of the prior art folded basket beverage carriers packaged in the Applicant's improved package.
Figure 3:
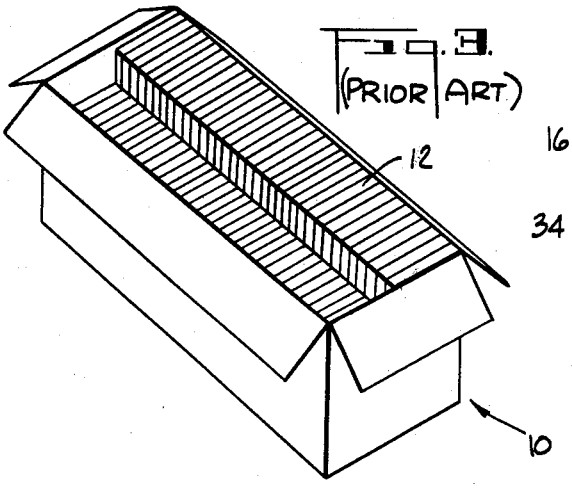
FIG. 3. (PRIOR ART)
FIG. 3 is a perspective view of a prior art regular slotted outer container utilized in prior art packaging of the folded basket beverage carriers shown in FIG. 1 and 2.
Figure 6:
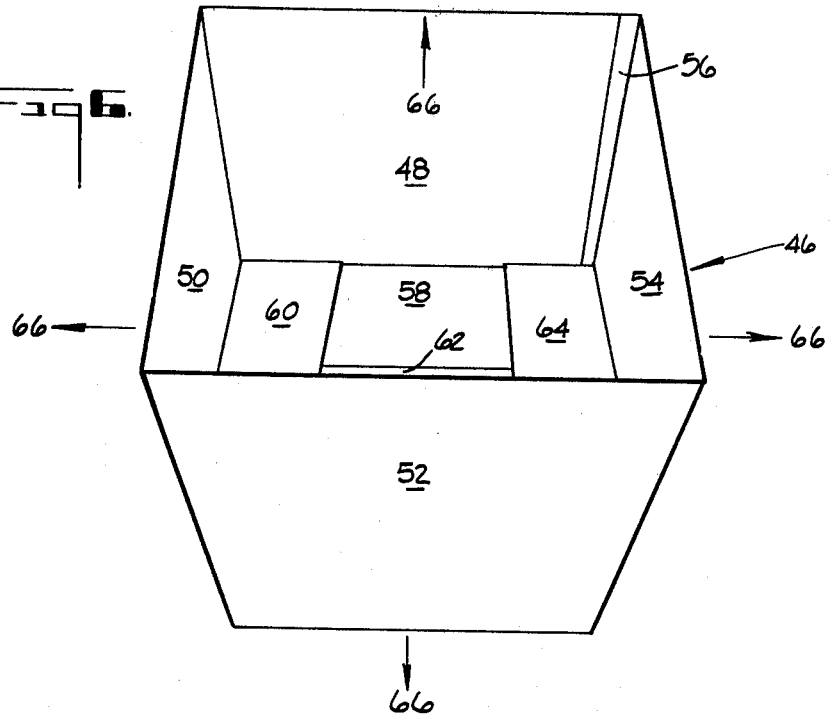
FIG. 6 is a perspective view of an outer restraint showing it prior to positioning the plurality of banded beverage carrier bundles.
Figure 7:
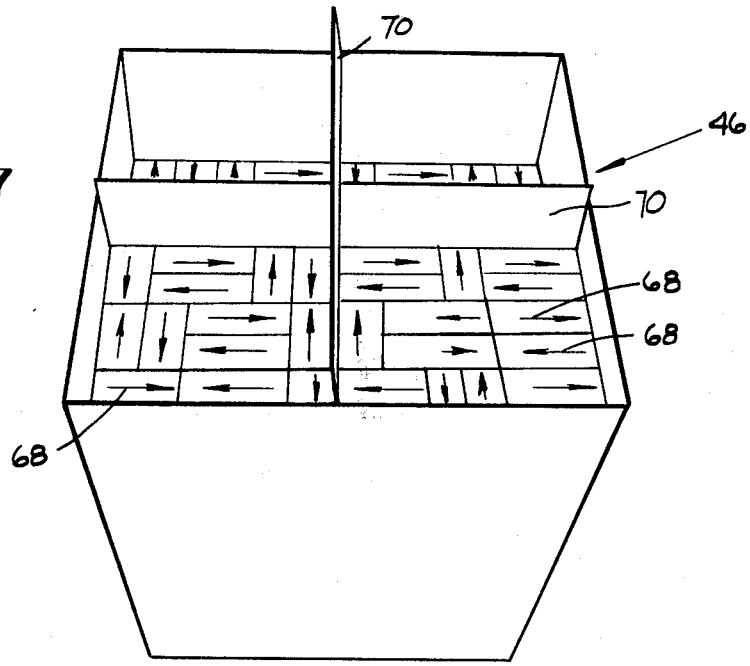
FIG. 7 is a perspective view of the outer restraint shown in FIG. 6 and showing a preferred method of positioning the banded beverage carrier bundles within the restraint.

Referring now to FIGS. 6 and 7 of the drawing there will be described in detail in lightweight, non-load bearing outer restraint 46 used with the Applicant's banded carriers which is positioned around the plurality of bundles of article carriers 12. The outer restraint 46 is designed to carry little or no weight from similarly constructed and filled restraints or other types of restraints which may be positioned on top thereof. Since it is a purpose of the Applicant's invention for the plurality of multiple article carrier bundles which have been banded as shown in FIG. 5 of the drawing, to carry the major portion of the weight of similar packages that may be positioned on top thereof, it can be seen that by designing the outer restraint 46 to carry little or no load, much economy can be obtained in the overall package than has been previously utilized in the industry. For example, it can be seen that when the multiple article carriers are packaged as shown in FIG. 3, the outer RSC container 10 must be designed to carry sufficient loads of several packages which may be placed on top thereof. For example, it is not unusual in the transportation of packages such as shown in FIG. 3 to pile similarly loaded packages to a height of 15 or more packages. This great load positioned on top of the bottom packages results in the outer RSC container 10 being constructed of much heavier and costly corrugated materials in order to carry the downwardly applied weight.

Referring again back to FIGS. 6 and 7 of the drawing the outer restraint 46 would be constructed having a plurality of side panels 48, 50, 52 and 54, hingedly attached to each other by a series of scorelines with the four side panels being held together in a tubular form by means of a manufacturers joint 56. The manufacturers joint 56 would be stapled, glued or taped to one of the side panels as is known in the art. A plurality of bottom flaps 58, 60, 62 and 64 would be hingedly attached to the side panels 48, 50, 52 and 54 by means of scorelines as is known in the art. When formed thusly it can be seen in FIG. 6 that the outer restraint 46 forms in essence a lightweight box or container into which is positioned the plurality of banded bundles of article carriers 12 as shown in FIG. 5 of the drawing. However, the outer restraint 46 is designed to be extremely lightweight and to carry little or no load of similarly positioned packages placed on top thereof as will be described more fully hereinafter. The outer restraint would then be simply designed to handle outward bulge as shown by the arrows 66 which may occur in later stacking.

Referring now to FIG. 7 of the drawing there is shown how the plurality of bundles of article carriers 12 may be positioned within the outer restraint 46 in order to minimize the outward bulge hereinbefore mentioned shown by the arrows 66. The plurality of bundles would be alternately positioned inside the outer restraint 46 as shown in FIG. 7 with the plurality of arrows 68 representing the direction that the various bundles would be turned and stacked within the restraint. As has been before mentioned, due to the slippery nature of the bundle resulting from the printed material on the central section of the carrier 14 and also resulting from the lenticular nature of the bundled package and internal shifting which may occur, it can be seen that it is advisable to alternately position the bundles as shown in FIG. 7 of the drawing. It may also be desirable to position a cross partition 70 down through the center of the outer restraint 46 to divide the stacks of bundles into four sections in order to minimize the outward bulging of the carriers as shown by the arrows 66.

Figure 8:
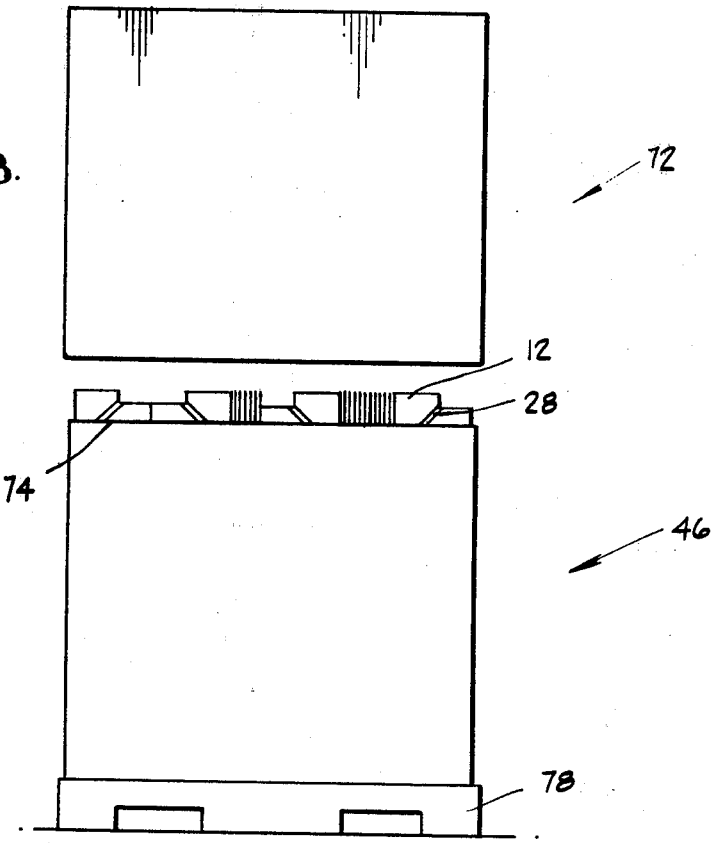
FIG. 8 is a side exploded view of an outer restraint showing the plurality of banded carriers being positioned in the restraint and further showing the upper portion of the restraint previous to its being positioned over the lower portion of the restraint, with the restraint being shown positioned on a pallet.
Figure 9:
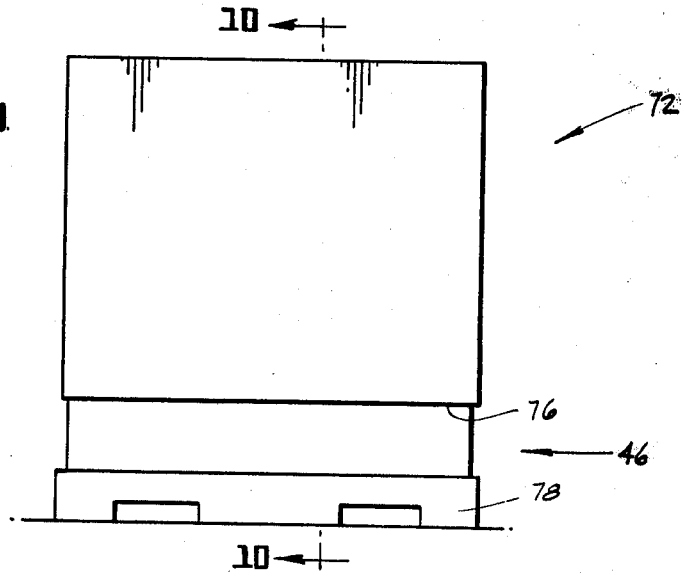
FIG. 9 is a side view of the preferred embodiment outer restraint showing the restraint in its final position as it would set on top of the pallet.

Referring now to FIGS. 8 and 9 of the drawing, when the outer restraint 46 is formed in the embodiment shown in FIG. 6 of the drawing it would have an upper outer telescoping container 72 formed of the type known in the art and having a plurality of upper flaps forming a top on the container. The upper flaps are not shown in FIG. 8 of the drawing but it should be made clear that the upper telescoping container 72 would also be formed of a lightweight non-load bearing corrugated material similar to the material formed by the lower outer restraint 46. In addition the upper telescoping container would be sized somewhat larger than the lower outer restraint 46 in order to fit over the lower restraint. When the plurality of multiple article carriers 12 which have been previously bundled together and banded by means of the diagonal band 28, are positioned in the outer restraint 46, they would be positioned in the restraint to a level shown in FIG. 8 of the drawing so that they would extend above the upper edge 74 of the restraint. When positioned thusly, it can be seen that whenever the upper telescoping container 72 is positioned over the outer restraint 46 as shown in FIG. 9 of the drawing that the lower edge 76 of the upper container 72 would not engage the pallet 78 upon which the completed package would be positioned. This is to ensure that the plurality of banded bundles of article carriers 12 will carry the major portion of the weight of similarly stacked packages and that the upper telescoping container 72 and the outer restraint 46 would carry little or at least a relatively minor portion of the load.

Figure 10:
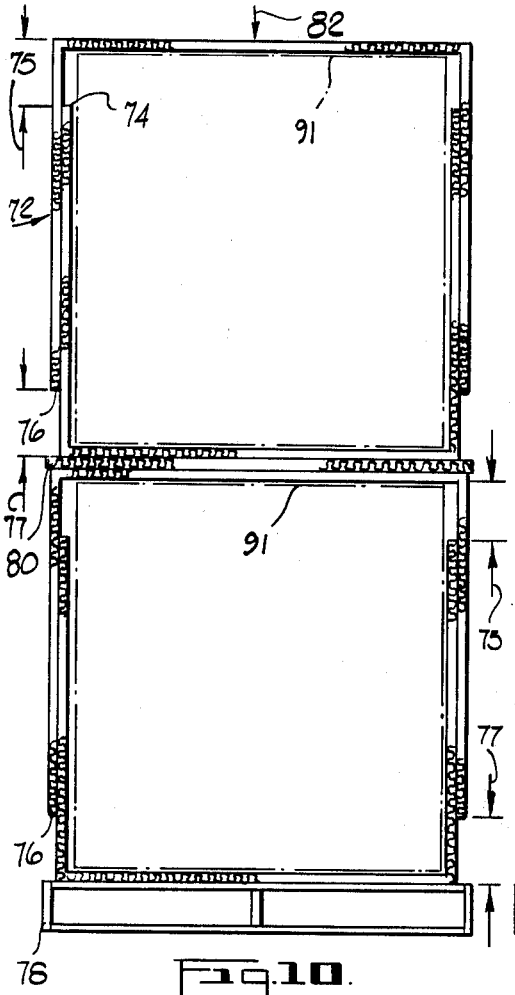
FIG. 10 is a cross-sectional view, taken along line 10—10 of FIG. 9, of the outer restraint showing a similar restraint positioned on top thereof and showing how the plurality of carrier bundles, shown in phantom in dot-dash lines 91, are utilized to carry a predetermined load.

By referring to FIG. 10 of the drawing, there can be seen a cross-sectional view, taken along line 10—10 of FIG. 9, of the outer restraint showing a similar restraint positioned on top thereof and showing how the plurality of lenticular shaped bundles of carriers 12 are utilized to carry a predetermined load. Since the lower edge 76 of the upper telescoping container 72 is cut so that its edge will not bear on either the flat sheet 80 positioned between the two container packages or on the pallet 78, little or no load will be transferred downwardly through the respective outer restraint packages whenever a similarly placed container would be positioned on top of the uppermost container as shown in FIG. 10. It may also be desirable to use a second pallet 78 in place of the flat sheet 80 when stacking a similar restraint as shown in FIG. 10. The downward load, represented by the arrow 82 would be transferred directly through the package to be carried by the plurality of lenticular shaped bundles formed by banding the plurality of carriers 12 together as has been before mentioned. In a similar manner, by positioning the plurality of banded carriers 12 in the outer restraint 46 above the upper edge 74, the chances of transferring any weight through the outer restraint would be minimal with the majority of the weight being transferred through the bundled packaged basket carriers. it should be recognized that due to other bulge in the container and the frictional contact between the outer restraint 46 and the upper telescoping container 72, only minimal quantities of load would be transferred through the outer restraint dependent upon the structural characteristics of that restraint.

Figure 11:
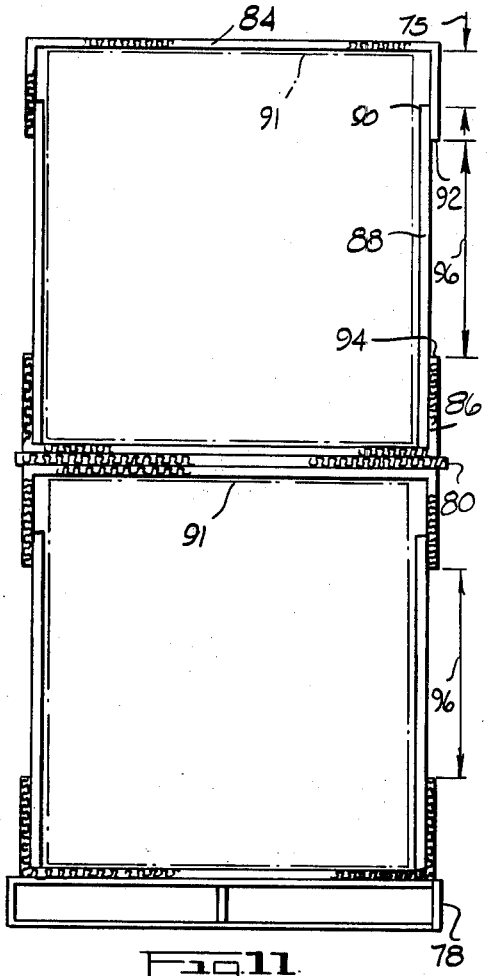
FIG. 11 is a cross-section view, similar to FIG. 10, of a modification of the outer restraint also showing a similarly formed outer restraint position thereupon and also showing how the plurality of carrier bundles, shown in phantom by dot-dash lines 91, are utilized to carry a predetermined load.

The height that the basket carrier bundles would be stacked in the outer restraint 46 above the upper edge 74 is shown by the arrows 75 in FIGS. 10 and 11. The distance that the upper telescoping container 72 would be cut short above the pallet 78 or the flat sheet 80 is shown by the arrows 77 in FIG. 10. These distances would be determined by the size of the carriers and would be such as to insure that the major portion of the downward load 82 is carried by the bundled carriers.

Referring now to FIG. 11 of the drawing there is shown a cross-sectional view of a modification of the outer restraint wherein the outer restraint is formed in a three-piece construction comprising an upper cap 84, a lower cap 86 and an intermediate sleeve 88. In this modification it can be seen that the upper edge 90 of the intermediate sleeve is positioned below the top 91 of the bundled carriers over which is positioned the upper cap 84. In a similar manner the bottom edge 92 of the upper cap 84 is spaced apart from the upper edge 94 of the lower cap 86 as shown by the arrow 96. In this manner little or no load would be transferred through the outer restraint with the majority of the load being carried by the plurality of the banded article carriers 12 positioned within the restraint.

In the embodiment shown in FIG. 11 the upper cap 84 and the lower cap 86 would be loosely fit over the intermediate sleeve 88 and would not be glued or stapled thereto again to ensure that the major portion of the load is carried by the internal article carriers 12 packaged within the restraint. The cap 84 would also preferably be held on the intermediate sleeve 88 by vertical straps around the package and/or the pallet 78 and applied under tension. The vertical straps would also be utilized in the embodiment shown in FIG. 10 and have not been shown on the drawing Figures. This allows the outer restraint to be designed as a non-load bearing body thereby allowing minimal amounts of corrugated paper board to be used in its construction.

Figure 12:
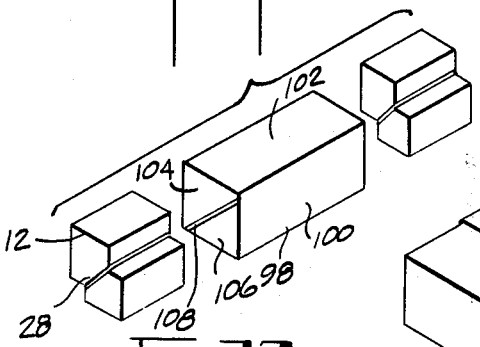
FIG. 12 is a perspective view showing another modification of the outer restraint wherein a plurality of banded carriers are positioned in an outer shell structure.
Figure 13:
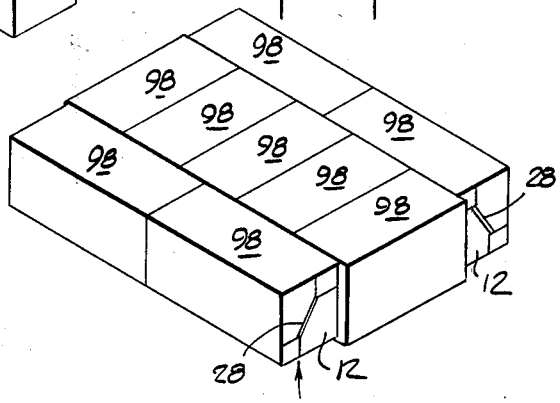
FIG. 13 is a perspective view of the modification shown in FIG. 12 showing the positioning of a plurality of outer shell structures.
Figure 14:
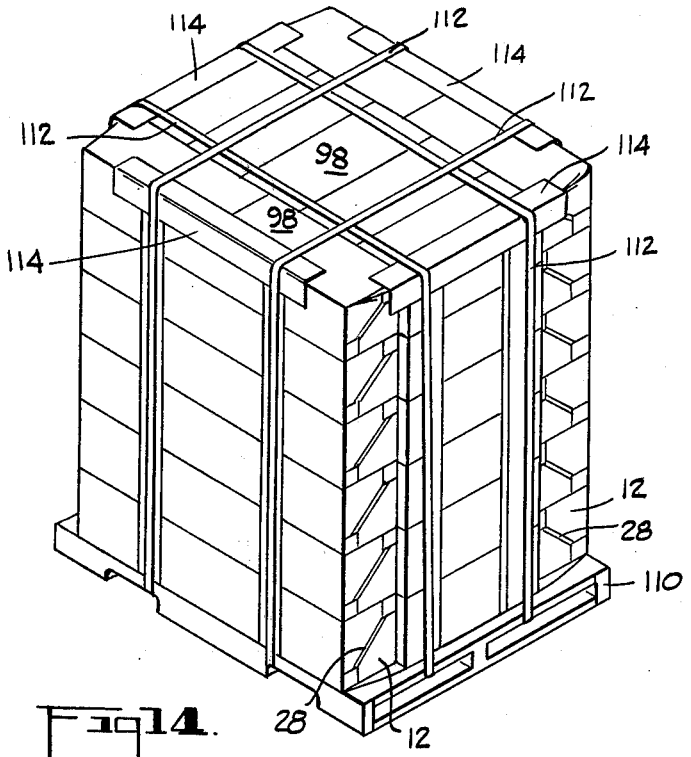
FIG. 14 is a perspective view showing the modified outer restraint of FIGS. 12 and 13 utilizing the plurality of outer shell structures and how they would be positioned on a pallet and banded together to form a non-load bearing outer restraint thereby utilizing the plurality of banded carriers to carry predetermined loads.

Referring now to FIGS. 12–14 of the drawing there is shown another modification of the outer restraint wherein a plurality of banded carriers 12 are positioned in an outer shell structure 98 which my be formed of corrugated paper board or folding carton paper stock. The outer shell structure 98 would comprise a plurality of sides 100, 102, 104 and 106 and would be formed in a tubular shell structure and held in place by a manufacturers joint 108 which would be glued or stapled or taped as is known in the art. As in the before mentioned embodiments, the shell structure 98 would serve as a lightweight non-load bearing outer restraint which would be positioned around the plurality of bundles. The inner bundles would serve to carry the major portion of the load of similarly wrapped bundles that may be positioned on top of each other in the overall package.

By referring now to FIGS. 13 and 14 it can be seen how a plurality of shells 98 would be positioned relative to each other after having a plurality of bundles of article carriers 12 positioned therein. The plurality of outer shell structures 98 containing the bundles would be positioned on a pallet 110 in the manner shown in FIG. 14 of the drawing and would be tightly banded on the pallet by means of banding straps 112 of the type known in the art. A plurality of corrugated pads 114 would be positioned over the uppermost layer of outer shell structures 98 in order to prevent damage to the shell structure in contact with the banding strap. The pads 114 could be corrugated, fiberboard or other angle-formed materials within the spirit and scope of the invention. It can be seen by referring to FIG. 14 of the drawing that whenever a similarly placed pallet loaded with outer shell structures 98 containing pluralities of inner carrier bundles 12 would be positioned on top of each other that the major portion of the weight on the package below would be carried by the plurality of banded carriers 12 and not by the outer shell structure 98 in a manner similar to the before mentioned preferred embodiment and modified embodiment of the invention. While the outer shell structure 98 may tend to carry some of the upper weight, it would be a minimal amount or a relatively minor portion of the total upper load.

From the foregoing it can be seen that whenever the various outer restraints are constructed so that the plurality of banded carriers 12 may be quickly removed from the respective outer restraints and can be placed in the feed hopper of the carton opener machine whereupon they would be opened in the customer's plant after the band 28 and/or the bands 34 and 36 would be cut and removed. The bundles can vary in the number of carriers up to an upper limit which is set by the weight that can easily be handled by an average worker. A good average number of carriers 12 in a bundle would appear to be about 30 carriers per bundle. The band 28 used for tightly banding the carriers can range in width from $\frac{1}{4}''$ to $\frac{3}{8}''$ with the type of material needed to give the desired strength. The stacking pattern on the pallet in the embodiment shown in FIGS. 12–14 can be designed to give the desired size pallet as preferred by the customer.

In the Applicant's new and novel method for packaging a plurality of the folded basket beverage carriers 12 for shipment to the customer, there is provided the steps of providing a plurality of folded basket beverage carriers having an upper handle section fixed to a central section and further having a lower offset bottom section which are aligned so that the handle sections are aligned together. After alignment the plurality of carriers are tightly banded into bundles around the central section in at least one position to form a diagonally positioned band between the upper handle section and the lower bottom section. Thereafter there is provided a lightweight, non-load bearing outer restraint around the tightly banded aligned carriers with the carriers then being loaded or positioned within the outer restraint in such a manner that the bundles carry the load of similarly filled restraints that may be placed on top of the lower restraint.

From the foregoing it can be seen that there has been provided by the subject application a new and novel multiple article package wherein a plurality of folded basket beverage carriers having lenticular shape are tightly banded together by at least one diagonally positioned band and are positioned in an outer restraint which is lightweight and non-load bearing. Several variations of the outer restraint have been disclosed and a new and novel method of packaging basket beverage carriers has also been disclosed. It can be seen from a review of the drawings and from a study of the description of the preferred embodiment and the modifications given thereafter, that changes may be made in the package and the method without departing from the spirit and scope of the invention. It should be understood that the invention is not to be limited to the exact embodiment given which has been presented by way of illustration only.

Having described my invention, I claim:

1. In a plurality of articles such as lenticular shaped folded basket beverage carriers packaged for shipment to a customer, the carriers being of the type having a central section, an upper offset handle section fixed to the central section and a lower offset bottom section fixed to the central section, the improvement comprising:

(a) a plurality of lenticular shaped articles positioned so that the upper offset handle sections are aligned together; and (b) at least one tight band positioned around the plurality of lenticular shaped articles around the central section to form a diagonally positioned band between the upper offset handle section and the lower offset bottom section, the tight diagonally positioned band serving to form the plurality of articles in a tight lenticular shape bundle capable of carrying a predetermined amount of weight that may be applied thereto.

2. The improvement as defined in claim 1 wherein the diagonally positioned band comprises a plastic strap which is machine applied around the plurality of lenticular shaped carriers while the carriers are compressed.

3. The improvement as defined in claim 2 wherein there is formed on each folded carrier at least two notches in which is positioned the diagonal band.

4. The improvement as defined in claim 1 further comprising the diagonally positioned band being formed in a width ranging from approximately $\frac{1}{4}''$ to $\frac{5}{8}''$.

5. The improvement as defined in claim 1 wherein the diagonally positioned band is formed of a plastic material.

6. The improvement as defined in claim 1 wherein the diagonally positioned band is formed of metal.

7. The improvement as defined in claim 1 wherein the diagonally positioned band is formed of paperboard.

8. A package of multiple quantities of lenticular shaped articles for shipment to a customer, comprising:

(a) a plurality of lenticular shaped bundles of folded lenticular shaped articles, each bundle being tightly banded together by a diagonally positioned band forming a lenticular shaped bundle;

(b) a lightweight, non-load bearing outer restraint positioned around the plurality of lenticular shaped bundles, the restraint being constructed so that the lenticular shaped bundles are stacked in the restraint in such a manner that a plurality of lenticular shaped bundles carry a major portion of the weight of a similar package that may be positioned on top thereof while the restraint carries a relatively minor portion of the load.

9. A method for packaging a plurality of folded lenticular shaped basket beverage carriers for shipment to a customer, comprising the steps of:

(a) providing a plurality of folded lenticular shaped basket beverage carriers having an upper offset handle section fixed to a central section and further having a lower offset bottom section;

(b) aligning the carriers so that the handle sections are aligned together;

(c) tightly banding, into lenticular shaped bundles, the aligned lenticular shaped carriers around the central section in at least one position to form a diagonally positioned band between the upper offset handle section and the lower offset bottom section;

(d) providing a lightweight, non-load bearing outer restraint around the tightly banded aligned lenticular shaped carriers;

(e) loading the tightly banded bundles within the outer restraint in such a manner that the lenticular shaped bundles carry the load of a similarly filled restraint that may be placed on top of the lower restraint.

* * * * *